US009940853B2

(12) United States Patent
Webb et al.

(10) Patent No.: US 9,940,853 B2
(45) Date of Patent: Apr. 10, 2018

(54) LABEL AND METHOD OF MANUFACTURING THE SAME FROM RECYCLED MATERIAL

(75) Inventors: Zachary Webb, Jamestown, NC (US); George Hoffman, Kernersville, NC (US); Harry Meredith, McLeansville, NC (US)

(73) Assignee: AVERY DENNISON RETAIL INFORMATION SERVICES, LLC, Mentor, OH (US)

( * ) Notice: Subject to any disclaimer, the term of this patent is extended or adjusted under 35 U.S.C. 154(b) by 0 days.

(21) Appl. No.: 12/966,064

(22) Filed: Dec. 13, 2010

(65) Prior Publication Data

US 2012/0164405 A1 Jun. 28, 2012

Related U.S. Application Data

(60) Provisional application No. 61/286,125, filed on Dec. 14, 2009.

(51) Int. Cl.
*G09F 3/00* (2006.01)
*D06H 7/04* (2006.01)
(Continued)

(52) U.S. Cl.
CPC ..... *G09F 3/0297* (2013.01); *D03D 1/0011* (2013.01); *D03D 15/00* (2013.01);
(Continued)

(58) Field of Classification Search
CPC ..... D03D 1/0011; D10B 2331/04–2331/042; G09F 3/00; G09F 3/02; G09F 2003/0225; G09F 2003/0226; G09F 2003/0227; G09F 2003/0229; G09F 2003/2064; G09F 2003/0266; G09F 2003/0267;
(Continued)

(56) References Cited

U.S. PATENT DOCUMENTS 2,740,457 A 4/1956 Wood
3,741,850 A 6/1973 Highfield
(Continued)

FOREIGN PATENT DOCUMENTS

CN 1046003 10/1990
CN 101568568 10/2009
(Continued)

OTHER PUBLICATIONS

Cruz Woven Label, Damask Woven Labels, Nov. 19, 2008, <http://web.archive.org/web/20081119161946/http://cruzlabel.com/damask-woven-labels.html>.*
(Continued)

*Primary Examiner* — Frank Vineis
(74) *Attorney, Agent, or Firm* — Avery Dennison Retail Information Services, LLC

(57) ABSTRACT

The present invention relates to brand identifiers, more particularly to woven labels used to mark, advertise or otherwise brand apparel and other consumer articles to identify the source of the particular goods. The woven labels of the present invention are preferably composed of post consumer waste or recycled materials, such as polyethylene, PET, polyester, cellulosic and other readily available materials that may be converted for the purpose of the present invention.

7 Claims, 3 Drawing Sheets

(51) Int. Cl.

| | |
|---|---|
| ***D06H 1/00*** | (2006.01) |
| ***D03J 1/08*** | (2006.01) |
| ***D03D 15/00*** | (2006.01) |
| ***D03D 1/00*** | (2006.01) |
| ***G09F 3/02*** | (2006.01) |

(52) U.S. Cl.
CPC ..... *D03J 1/08* (2013.01); *D06H 1/00* (2013.01); *D06H 7/04* (2013.01); *D10B 2321/021* (2013.01); *D10B 2331/04* (2013.01); *G09F 2003/0208* (2013.01); *G09F 2003/0223* (2013.01); *G09F 2003/0282* (2013.01); *Y10T 428/2481* (2015.01)

(58) Field of Classification Search
CPC ..... G09F 2003/0269; G09F 2003/2082; B65C 5/00; B65C 5/02; B65C 5/04; B65C 5/06; D06H 1/04; D06H 1/046; D05B 3/20; Y10T 83/041; Y10T 83/0414; B26D 7/10
USPC ..... 442/181, 185, 59; 283/117; 112/104–115; 2/244–246; 26/7–15 FB; 28/170; 83/15–16
See application file for complete search history.

(56) References Cited

U.S. PATENT DOCUMENTS

| | | | | |
|---|---|---|---|---|
| 4,069,727 | A * | 1/1978 | Sparks | B26F 3/06 156/251 |
| 4,351,871 | A * | 9/1982 | Lewis et al. | 428/32.6 |
| 4,352,703 | A | 10/1982 | Perron | |
| 4,541,340 | A * | 9/1985 | Peart | B41M 5/0358 101/32 |
| 4,699,678 | A | 10/1987 | Mims | |
| 5,601,671 | A * | 2/1997 | Speich | 156/88 |
| 7,465,695 | B2 * | 12/2008 | Tischer et al. | 503/227 |
| 2008/0238667 | A1 * | 10/2008 | Olson | 340/541 |
| 2008/0242751 | A1 * | 10/2008 | Kurian et al. | 521/48.5 |
| 2009/0113681 | A1 * | 5/2009 | Yidi, Jr. | 28/143 |

FOREIGN PATENT DOCUMENTS

| | | |
|---|---|---|
| CN | 101578640 | 11/2009 |
| EP | 0164236 | 12/1985 |
| EP | 0389793 | 10/1990 |
| WO | WO 2008089046 A1 * | 7/2008 |

OTHER PUBLICATIONS

Environmental Leader, Avery Dennison Puts FSC Logo on Clothing Tags, Mar. 17, 2008, <http://www.environmentalleader.com/2008/03/17/avery-dennison-puts-fsc-logo-on-clothing-tags>.*

Libolon, Libolon RePET, Oct. 15, 2008, http://www.libolon.com/repet.php.*

International Search Report dated Apr. 7, 2011 for International Application No. PCT/US2010/059997 filed Dec. 13, 2010.

Written Opinion dated Apr. 7, 2011 for International Application No. PCT/US2010/059997 filed Dec. 13, 2010.

"Avery Dennison Introduces Eco-Friendly Woven Edge Tape Made from 100% Post Consumer Waste"; Avery Dennison Corporation News Release; Apr. 22, 2009.

English Translation of First Office Action and Search Report of the State Intellectual Property Office of P.R.C. dated Apr. 8, 2014 for Chinese Application No. 201080056808.1 filed Dec. 13, 2010.

European Search Report dated Apr. 3, 2017 for European Application No. EP 16 00 2613 filed Dec. 7, 2016.

* cited by examiner

LABEL AND METHOD OF MANUFACTURING THE SAME FROM RECYCLED MATERIAL

CROSS-REFERENCE TO RELATED APPLICATION

The present application claims the benefit of U.S. Provisional Application No. 61/286,125 filed Dec. 14, 2010, which is incorporated herein by reference in its entirety.

FIELD OF THE INVENTION

The present inventive subject matter relates generally to the art of woven fabric material and/or labels made therefrom. Particular relevance is found in connection with brand identification such as may be used with garment and/or apparel labels and/or other consumer products, and accordingly the present specification makes specific reference thereto. However, it is to be appreciated that aspects of the present inventive subject matter are also equally amenable to other like applications.

BACKGROUND OF THE INVENTION

Most garments or apparel items contain at least one brand identifier, product data or other information. The brand identifier may be printed, imaged or fully woven fabric, to create a brand identification label or tag. For example, these labels may contain any one or more of the following pieces of information: brand name, logo, fiber content, country of origin, care instructions, manufacturer codes, production lot, etc. The majority of these fabric labels are made of 100% polyester yarn. Other materials might include nylon, TYVEK®, cotton, etc. Polyester is used often due its desirable properties, e.g., such as low cost, high tear resistance and fabric hand or feel.

One common polyester fabric material used for labels is known generally as woven edge tape (WET). This material is typically woven in narrow ribbons whose width conforms to the final width the individual label. For example, if the finished label size is 60 mm in length and 33 mm wide, then that base material would typically be woven on a loom which weaves several 33 mm wide ribbons at one time. A conventional WET loom (referred to as a six space loom) may weave as many as 6 separate ribbons at a time.

WET has grown in popularity in part as a result of consumer preference for a softer label edge created by the weaving process combined with advances in rotary letterpress printing technology. The prior alternative method of creating polyester ribbon material was to weave polyester fabric in large widths (e.g., 50"-60") and then hot slit it into individual ribbons. However, this created a label with an objectionably scratchy edge as the fused edge of the polyester material developed a crust. The advances in printing technology included the ability to print both the front and back side of the label and at the same time to be able to print up to six colors. Prior to this advancement commercial fabric label printing was limited to printing only 3 colors on one side of the label using screen printing.

With regard to label production, there is increasing interest in sustainability and/or environmentally friendly practices. For example, there is generally interest in adopting practices which reduce energy consumption, eliminate the use of carcinogenic and/or hazardous materials, employ more renewable or recycled source material, etc. In addition, there is a desire to increase the level of personalization and brand identity labeling.

There is a current desire that is being driven by a new level of consciousness related to preserving resources and the environment. Retailers and retail brand owners in an effort to satisfy the demands of consumers have begun seeking new ways to respond to consumer requests as well as delivering an impactful way of maintaining the brand integrity.

Accordingly, a new and/or improved fabric label and/or method for producing the same is disclosed which addresses the above-referenced problem(s) and/or others.

BRIEF SUMMARY OF THE INVENTION

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

In accordance with one embodiment, a woven edge tape and/or label made therefrom as essentially described herein is provided.

In accordance with another embodiment, a method as essentially described herein is provided for making a woven edge tape and/or label therefrom.

In a further exemplary embodiment, a woven label material is provided having a pair of woven edges that run parallel to a machine direction, the woven label material is constructed from 100% post consumer waste material and is provided with indicia that may be printed by at least one of thermal transfer, direct thermal, wet ink or hot stamping. The woven edges extend both above and below a plane created by the woven material.

In a still further exemplary embodiment of the presently described invention, a method of making a woven edge label is described and includes the steps of initially providing a continuous web of material composed of approximately 100% post consumer waste. Then, separating the web into individual widths of material, each width corresponding to a width of a brand identification label. Next, first and second edges are created on each of the individual widths of material and each of the individual widths of material are printed with indicia. Finally, each of the individual widths of material are cut into separate brand identification labels.

In a still further exemplary embodiment of the presently described invention includes an apparel item to which a woven label constructed of approximately 100% post consumer waste is attached. The woven label including at least one of brand identification and care instructions and a security feature selected from at least one of EAS or RFID.

Other features and advantages of the present invention will become apparent to those skilled in the art from the following detailed description. It is to be understood, however, that the detailed description of the various embodiments and specific examples, while indicating preferred and other embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The inventive subject matter disclosed herein may take form in various components and arrangements of components, and in various steps and arrangements of steps. The drawings are only for purposes of illustrating preferred embodiments and are not to be construed as limiting. Further, it is to be appreciated that the drawings may not be to scale.

DETAILED DESCRIPTION OF THE INVENTION

Figure 1:
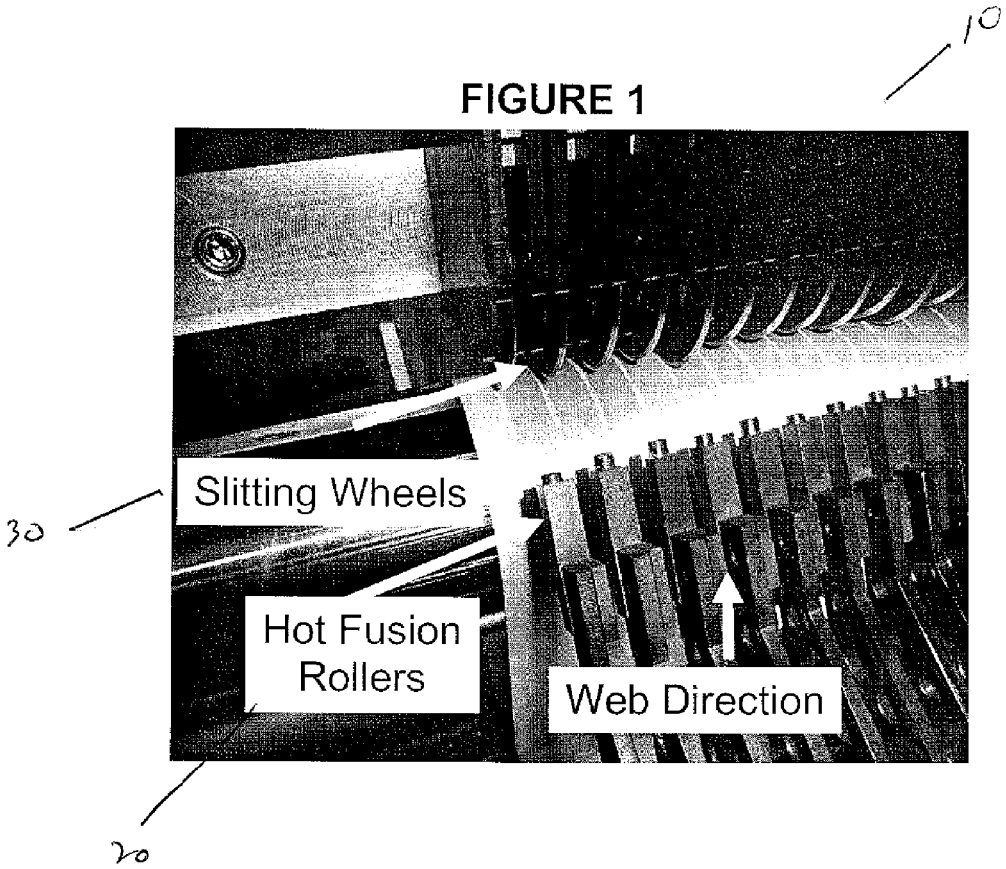
FIG. 1 is photograph showing a slitter having distinct fusing and cutting operations used to convert a broad woven fabric into a plurality of ribbons in accordance with aspects of the present inventive subject matter.

The apparatuses and methods disclosed in this document are described in detail by way of examples and with reference to the figures. Unless otherwise specified, like numbers in the figures indicate references to the same, similar, or corresponding elements throughout the figures. It will be appreciated that modifications to disclosed and described examples, arrangements, configurations, components, elements, apparatuses, methods, materials, etc. can be made and may be desired for a specific application. In this disclosure, any identification of specific shapes, materials, techniques, arrangements, etc. are either related to a specific example presented or are merely a general description of such a shape, material, technique, arrangement, etc. Identifications of specific details or examples are not intended to be, and should not be, construed as mandatory or limiting unless specifically designated as such. Selected examples of apparatuses and methods are hereinafter disclosed and described in detail with reference made to FIGURES.

The present specification describes a woven fabric material and/or label along with a method for producing the same, wherein the material or label retains all or many of the performance characteristics of a conventional WET while being made largely from recycled material, e.g., 100% or nearly 100% post-consumer recycled material. In particular, the present specification describes a broad woven fabric which is cut to emulate a WET and is made from 100% or nearly 100% post-consumer recycled, polyester, PET (polyethylene terephthalate) and/or a method for producing the same. Suitably, the recycled polyester, PET is obtained from recycled plastics, such as soda bottles, consumer packaging or other similar beverage bottles or the like.

Suitably, the material and/or label proposed herein has a hand or feel (e.g., softness, etc.) which is as good or better than conventional WET, and the cost of material is equal to or less than conventional WET products. In exemplary embodiments, a ribbon cut from the broad woven fabric has an edge with the following qualities:

a. durability, i.e., an edge that does not unravel during laundering, e.g., as evidenced by it suitably standing up to an industry standard AATCC (American Association of Textile Chemists and Colorists) method 61-option 3A test;

b. softness, i.e., the edge is as smooth or smoother than the edge of conventional WET material; and, c. visual appearance, i.e., the edge looks somewhat like a conventional woven edge, e.g., with a selvedge of approximately 0.7 to 0.8 mm wide.

In one exemplary embodiment, the ribbon conversion process is able to convert broad woven fabric (e.g., 60"-70" wide) at very high speeds (e.g., 90-180 feet/min) in order to meet large demands. In contrast, traditional hot knife slitting of polyester not only yields an inferior rough edge but is also very slow, e.g., as slow as 10-20 ft/min, making it an impractical process for meeting the demands for very large volumes of converted ribbons.

Suitably, the fabric proposed herein contains or has certain properties (e.g., discoverable via forensic testing or otherwise) so that it can be distinguished from its virgin polyester counterparts. This is desirable since customers may from time to time want to validate that the fabric used for the labels is truly made of recycled material. For example, there has been developed a means to distinguish the new labels or material disclosed herein from conventional virgin polyester WET. In particular, the method employs XRF (X-ray fluorescence) analysis which is a spectroscopic method that is commonly used to identify materials or components thereof in which secondary X-ray emission is generated by excitation of a sample with X-rays and can show the existence of certain chemicals which are not found in virgin polyester but are a component of recycled material. Another method known as DSC (Differential Scanning Calorimetry) may also be used. In particular, the melting point of virgin polyester is different from that of recycled PET and DSC analysis determines if the fabric is made of virgin polyester or recycled material or some blend thereof based upon this difference.

Optionally, the fabric is also able to be visibly authenticated. For example, a particular logo or trademark or other identifier (e.g., in the form of a watermark or the like) is applied to a fabric surface. Suitably, the identifier meets the following criteria: a) it is visible but does not adversely affect the legibility or washability of other printed text or the like appearing on the finished label; and b) it is legible or otherwise visible to the human eye and of a size where at least one complete logo or image appears on any label that is of a minimum area, i.e., equal to the minimum size of a label cut therefrom, e.g., a 18 mm by 30 mm label.

The fabric or material may also contain indicia which can be produced in a number of ways such as by direct thermal printing, thermal transfer printing, flexographic, gravure, wet ink, hot stamping, non-impact printing or by any other suitable means.

The fabric or material web may also be provided with security devices, such as an EAS device or an RFID device, which can be provided at regularly spaced intervals that correspond to the individual length of a fabric label.

In order to achieve a very soft hand, a light weight weave construction is employed using a fine denier yarn. Suitably, the weave construction of the fabric includes a 75 denier yarn in the fill direction and a 150 denier yarn in the warp direction. In one exemplary embodiment, a 75 denier yarns is used in both the warp and fill to give even a softer feel.

Suitably, the yarn used is made from recycled PET (RPET) that is extruded into filaments or strands. In one suitable embodiment, each 75 denier yarn is actually comprised of 36 individual strands or filaments which are twisted in line to make the one yarn. The finer the denier yarn the more difficult it is for a yarn extruder to make using RPET due to the fact that the RPET often has minute impurities therein. For example, these impurities originate from recycled bottles and can be comprised of paper, polyethylene from the bottle cap, glass, etc. Making this fine denier of a yarn using RPET is difficult, e.g., since the impurities tend to block up the filter portion of the extrusion unit. Notably, due to the fact that the individual strands are so fine in 75 denier yarn, any impurities making there way into the yarn can result in a web break on the extruder or adversely impact the tensile strength of the completed yarn which then might create a yarn break on the weaving machines in subsequent production of the fabric itself. Accordingly, it is important to strike an optimal balance between the two opposing factors of the yarn: lower denier for softness and higher denier for strength.

Hand is generally a function of the overall weight of the fabric. A traditional fabric weight for WET labels is around 125-130 gms/m$^2$. However, RPET yarn is generally more costly then traditional polyester yarn. Accordingly, in order to achieve good hand and also to achieve lower costs, a fabric construction made from RPET yarn as proposed herein has a weight of approximately 110-115 gms/m$^2$, thereby reducing the amount of yarn employed and in turn reducing the cost of production. Additionally, reduced weaving costs are realized by weaving in large widths, e.g., about 60"-70", and slitting at higher speeds, rather than weaving individual ribbons which is much slower.

In general, it is desirable for a label to have a durable edge, but it is also desirable to produce the ribbons at relatively high speeds. With conventional slitters, a relatively wide fabric web is cut into ribbons or otherwise divided with one or more heated slitting knives. To get a sufficiently durable edge, a conventional slitter typically runs at a speed of about 10-15 fpm (feet per minute). The relatively slow speed allows a sufficient dwell time of the knife next to or proximate the created edge of the ribbon in order for the heat from the knife to properly melt and fuse the polyester, thereby creating the desired durable edge. If a conventional slitter is run faster, there is commonly insufficient time for the heat from the knife to suitably fuse the edge and impart the desired durability. Of course, it is to be understood that the amount of heat transferred from the knife in a given time (e.g., via conduction) to sufficiently melt and/or fuse the edge of the ribbon is limited in part by the relatively thin or narrow edge of the knife making contact with the fabric. According to Fourier's Law, when two solid bodies come into contact with one another (e.g., the heated knife and the fabric web), heat flows from the hotter body to the colder body and the heat flow is directly related to the contact area between the bodies. Therefore, when the contact area is relatively small (e.g., as is the case when the edge of the heated knife contacts the fabric), then the heat flow from the knife to the fabric is also relatively small. Accordingly, a longer dwell time and/or slower run speed is demanded in order to permit a sufficient amount of heat to be transferred so that the edge of the ribbon is suitably melted and/or fused to the degree appropriate for achieving the desired durability.

With reference now to FIG. 1, there is shown an exemplary slitter 10 usable in accordance with aspects of the present inventive subject matter. Generally, the present slitter divides, (i) the fusing function and (ii) the cutting or slitting function, into two distinct operations.

First, the web under goes fusing where the edge of each ribbon is to be ultimately formed. As illustrated in FIG. 1, one or more heated fusing elements or rollers 20 conduct the fusing. Suitably, a plurality of heated fusing elements or rollers 20 are spaced out along the width of the web at the desired slitting locations or widths. More specifically, at and/or near the region where the heated fusing elements contact the web, the fabric or fibers thereof are melted and/or fused together. Accordingly, as the web moves past each of the heated fusing elements 20, this forms a track wherein the fabric or fibers of the web are fused together.

Second, the web is run past one or more slitting knifes or cutting wheels 30. For example, as shown in the illustrated embodiment, there is one knife or cutting wheel that corresponds to each heated fusing element/roller 20. More specifically, each slitting knife or cutting wheel is likewise space out along the width of the web at the desired slitting locations or widths. Suitably, each knife or cutting wheel cuts or otherwise separates the web at or near the middle of the fused track formed by the corresponding heated fusing element/roller. Suitably, the width of the track is controlled by the width of the heated fusing element/roller. For example, in one suitable embodiment, the heated fusing element/roller has a size and/or width that is chosen so that when the track is slit or otherwise divided in half it yields a fused edge with a width of approximately 0.7 mm to approximately 0.8 mm, which gives the slit fabric the appearance of a traditional WET which has a woven selvedge of about 0.6 mm.

Notably, without an appreciable loss of desirable edge quality, the run speed of the slitter illustrated in FIG. 1 is significantly improved over traditional slitters employing heated knifes to perform both the fusing and cutting functions. In part, this is because the fusing is performed by a separate element or roller which in turn improves the heat transfer to the web due the larger contact area therewith as compared to the contact area achieved with a conventional heated knife. That is to say, insomuch as the contact area is enlarged to allow better heat transfer to the web, the run speed of the web can be increased while still permitting a sufficient amount of heat to be transferred to the web so as to obtain a suitable degree of melting and/or fusing of the web fibers that in turn results in the quality edge desired.

Figure 2:
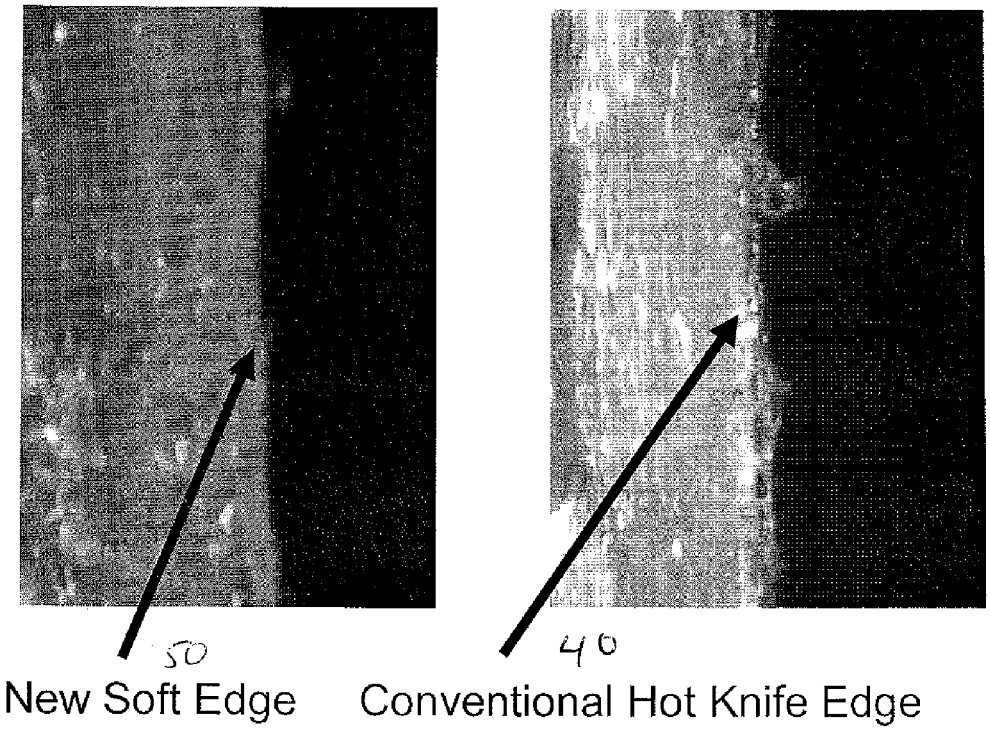
FIG. 2 shows micrographs of different ribbon edges for comparison, one produced in accordance with aspects of the present inventive subject matter, the other produced conventionally.

For example, FIG. 2 shows micrographs of the edges of two different ribbons for comparison. Notably, the edge 50 produced by the present method (as shown in the image on the left) as compared to the conventional process 40 (as shown in the image on the right) is smoother and hence has a softer feel. Again, suitably, the ribbon conversion process is able to convert broad fabric woven (e.g., from about 60" to about 70" wide) at very high speeds (e.g., from about 90 to about 180 feet/min) in order to meet large demand. Traditional hot knife slitting of polyester not only yields an inferior rough edge but is also very slow (e.g., from about 10 to about 20 ft/min) making it an impractical process for meeting very large volumes of converted ribbons.

Optionally, to provide visual identification of the label as being made from recycled material, a logo or other image or some form of indicia or identifier is printed on the fabric surface that will provide visual confirmation that the fabric is in fact made of recycled material, e.g., 100% or nearly 100% recycled PET. In order to achieve this, a suitable pattern is print in a very faint watermark across the web of the fabric, e.g., just after weaving it. Suitably, the printing is done while the fabric is in wide form (e.g., 60"-70") in order to make it economical. For example, the printing technology can be either be ink jet or rotary screen if printed in wide form. Optionally, the fabric can be printed using a dry toner digital press.

Figure 3:
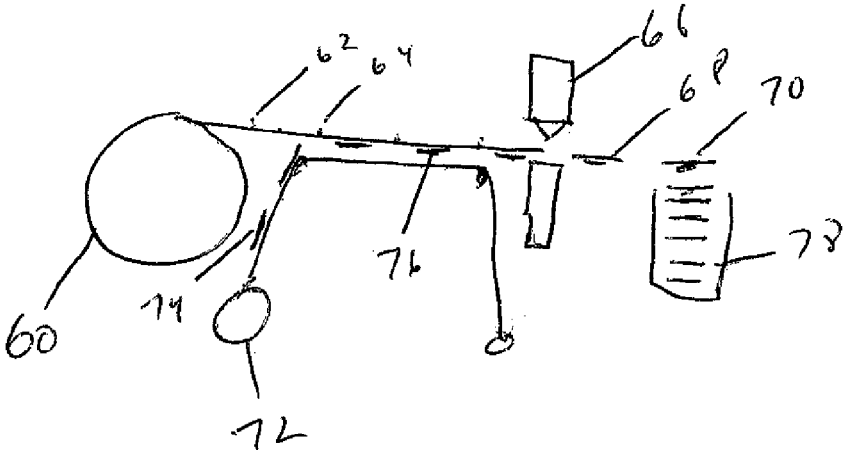
FIG. 3 provides the woven material being cut into individual label lengths.

Reference is now directed to FIG. 3 which provides a schematic of a process for producing brand identification labels of the presently describe invention. The material is provided in a continuous format 60 having a plurality of segments 62, 64 defining individual label lengths. The continuous web is fed to a cutting device 66 which separates the web 60 into individual brand identification labels 68, 70. A web 72 providing security devices 74, 76 are unwound and attached to each of the brand identification labels as they advance beyond a particular position. The security devices may be provided as "inlay" such as are available from Avery Dennison RFID Company of Clinton, S.C. The inlays may be attached via adhesive or may be included as in a pocket formed in the web of material. The separated brand labels 68, 70 are then collected 78 for later use.

Figure 4:
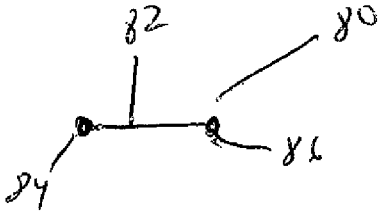
FIG. 4 shows a side elevation of an individual brand identification label.

FIG. 4 provides a cross section of a brand identification label 80 produced in accordance with the present invention. The label 80 has a planar surface 82 which makes up at least 90% of the surface area of the label and preferably more than about 95%. The label 80 has first and second edges 84 and 86 which are produced in a machine direction. As can be seen from the drawing, the first and second edges extend above and below the planar surface and are generally perpendicular to the planar surface.

Figure 5:
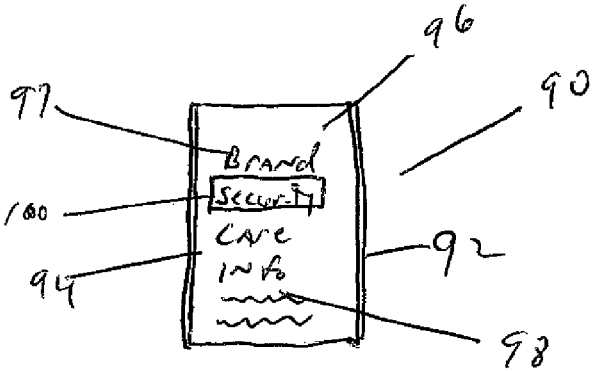
FIG. 5 depicts a front few of an individual brand identification label.

Turning now to FIG. 5, a complete brand identification label 90, having first and second edges 92, 94 running substantially longitudinally to the planar surface 96. The planar surface 96 is provided with indicia 97, 98 which may identify the brand and provide care instructions. In addition, the label 90 is shown with a security device 100.

Figure 6:
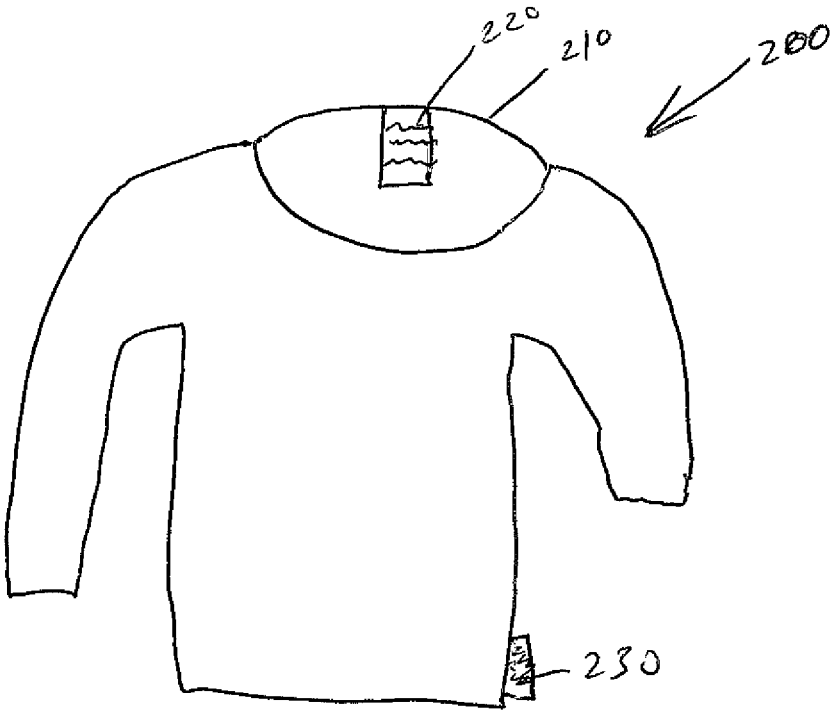
FIG. 6 illustrates a brand identification label produced in accordance with the present invention attached to an apparel item.

Reference is directed to FIG. 6, which shows an apparel item 200 having an opening 210 to which a first brand identification label is attached 220 in the opening and a second label 230 is attached at a different location.

In any event, it is to be appreciated that in connection with the particular exemplary embodiment(s) presented herein certain structural and/or function features are described as being incorporated in defined elements and/or components. However, it is contemplated that these features may, to the same or similar benefit, also likewise be incorporated in other elements and/or components where appropriate. It is also to be appreciated that different aspects of the exemplary embodiments may be selectively employed as appropriate to achieve other alternate embodiments suited for desired applications, the other alternate embodiments thereby realizing the respective advantages of the aspects incorporated therein.

It is also to be appreciated that particular elements or components described herein may have their functionality suitably implemented via hardware, software, firmware or a combination thereof. Additionally, it is to be appreciated that certain elements described herein as incorporated together may under suitable circumstances be stand-alone elements or otherwise divided. Similarly, a plurality of particular functions described as being carried out by one particular element may be carried out by a plurality of distinct elements acting independently to carry out individual functions, or certain individual functions may be split-up and carried out by a plurality of distinct elements acting in concert. Alternately, some elements or components otherwise described and/or shown herein as distinct from one another may be physically or functionally combined where appropriate.

It will thus be seen according to the present invention a highly advantageous fabric label constructed from recycled material has been provided. While the invention has been described in connection with what is presently considered to be the most practical and preferred embodiment, it will be apparent to those of ordinary skill in the art that the invention is not to be limited to the disclosed embodiment, and that many modifications and equivalent arrangements may be made thereof within the scope of the invention, which scope is to be accorded the broadest interpretation of the appended claims so as to encompass all equivalent structures and products.

What is claimed is:

1. An apparel article, comprising;

an apparel article;

at least one woven brand identification label comprising a woven material attached to the apparel article, the brand identification label having a planar surface constructed from approximately 100% post consumer waste material having a 75 denier yarn in a fill direction and a 150 denier yarn in a warp direction and an edge extending both above and below the planar surface having a fused edge of approximately 0.7 to 0.8 mm;

wherein the post consumer waste material has a width from 60 inches to 70 inches;

the at least one brand identification label including printed indicia and a security feature; and wherein the printed indicia is provided by one of direct thermal, thermal transfer, flexographic, gravure, hot stamping or combination thereof;

wherein the material is able to be visibly authenticated as being made from recycled material by applying an identifier visible to a human eye to the planar surface of the woven edge tape; and the woven material is first fused and then cut along a length of the woven material to create individual brand identification labels and the security feature is selected from a group including an EAS device and a RFID device, and the woven material is converted at run speeds from approximately 90 to approximately 180 feet/min.

2. The apparel article as recited in claim 1, wherein the woven material has a weight of approximately 110-115 $gm/m^2$.

3. The apparel article as recited in claim 1, wherein the planar surface includes about 95% of the woven material.

4. The apparel article as recited in claim 1, wherein the woven material includes a security feature that is an EAS device.

5. The apparel article as recited in claim 1, where the at least one brand identification label has a printed watermark.

6. The apparel article as recited in claim 1, where a first brand identification label is attached in an opening of an apparel item and a second label is attached at a different location of the apparel item.

7. The apparel article as recited in claim 1, where the post consumer waste is PET.

* * * * *